US010568478B2

(12) United States Patent
Hutchins

(10) Patent No.: US 10,568,478 B2
(45) Date of Patent: Feb. 25, 2020

(54) WASTE TRANSFER AND DISPOSAL SYSTEM FOR BAGLESS VACUUM CLEANERS

(71) Applicant: Christy Z Hutchins, Gansevoort, NY (US)

(72) Inventor: Christy Z Hutchins, Gansevoort, NY (US)

( * ) Notice: Subject to any disclaimer, the term of this patent is extended or adjusted under 35 U.S.C. 154(b) by 206 days.

(21) Appl. No.: 15/086,431

(22) Filed: Mar. 31, 2016

(65) Prior Publication Data

US 2016/0278591 A1 Sep. 29, 2016

Related U.S. Application Data

(63) Continuation-in-part of application No. 13/757,765, filed on Feb. 2, 2013, now abandoned.

(60) Provisional application No. 61/703,324, filed on Sep. 20, 2012.

(51) Int. Cl.
*A47L 9/14* (2006.01)

(52) U.S. Cl.
CPC ..... *A47L 9/149* (2013.01)

(58) Field of Classification Search
CPC ..... B65D 33/18; A47L 5/365; A47L 9/1445; A47L 9/1436; A47L 9/1427; A47L 9/149; B65F 1/002; B65F 2210/148
USPC .... 383/33, 211, 61.4, 72, 50, 57, 82, 83, 85, 383/88, 89, 118; 220/92; 55/361, 367, 55/DIG. 2, 378, 369, 374; 15/347, 15/DIG. 8
See application file for complete search history.

(56) References Cited

U.S. PATENT DOCUMENTS

| | | | | |
|---|---|---|---|---|
| 2,585,214 A * | 2/1952 | Belmont | B65D 33/24 383/43 |
| 7,914,207 B1 * | 3/2011 | Beam | B31B 19/90 220/495.11 |
| 2007/0248290 A1 * | 10/2007 | Melvan | B65D 33/14 383/43 |
| 2009/0060397 A1 * | 3/2009 | Allegro, Jr. | B65D 33/20 383/4 |

* cited by examiner

*Primary Examiner* — Nathan J Newhouse
*Assistant Examiner* — Matthew T Theis
(74) *Attorney, Agent, or Firm* — Jeffrey Roddy

(57) ABSTRACT

A system for the collection and containment of vacuumed dust and debris, and more particularly to waste disposal bags for placement over a portion of a bagless vacuum cleaner, and into which the waste contents of the vacuum cleaner are emptied. The system includes a mouth with a projecting lip, a non-projecting lip and a light tack adhesive strip on the projecting or non-projecting lip. When the mouth is constricted about a portion of the bagless vacuum cleaner, the light tack adhesive strip adheres the bag for temporary affixment to the vacuum cleaner. The projecting lip serves as a flap that is folded over the mouth to seal the bag after the filled bag is separated from the vacuum cleaner.

10 Claims, 15 Drawing Sheets

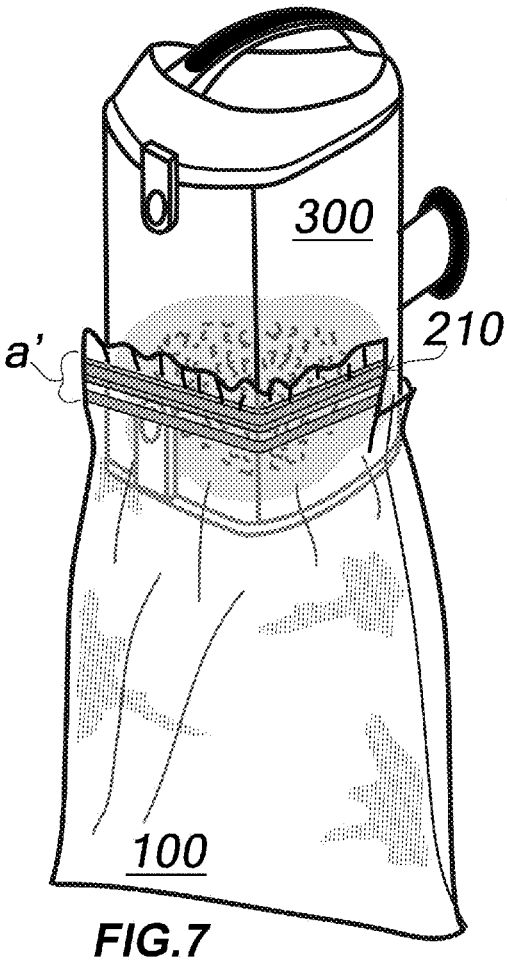
FIG.7
FIG.8
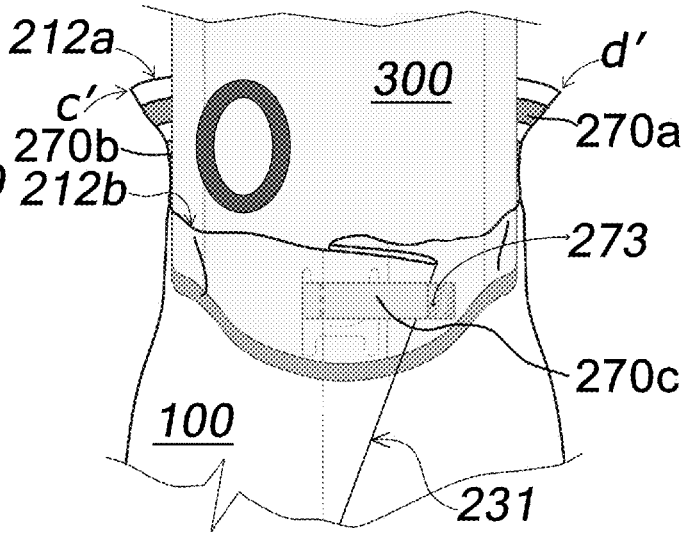
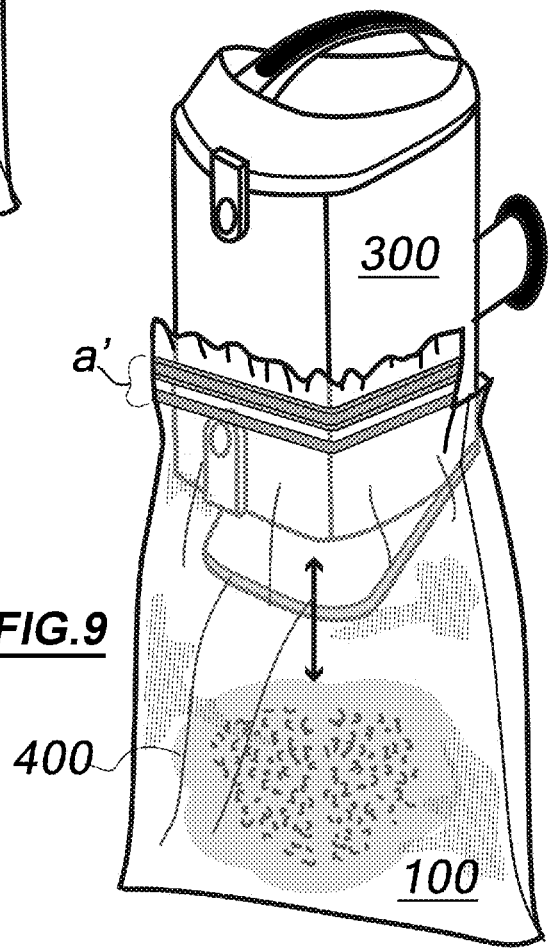
FIG.9

FIG.15a
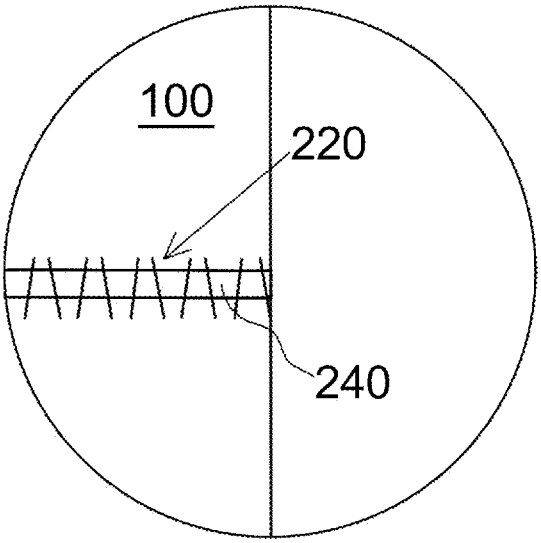
FIG.15b
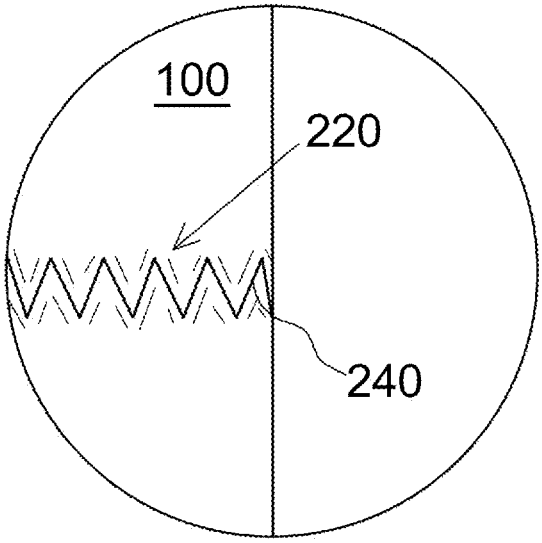
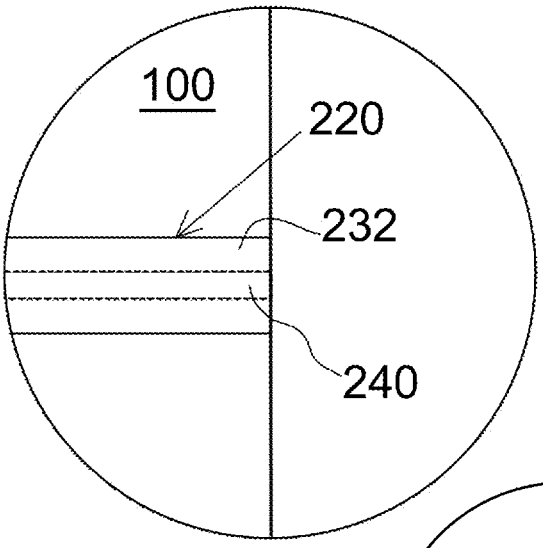
FIG.15c
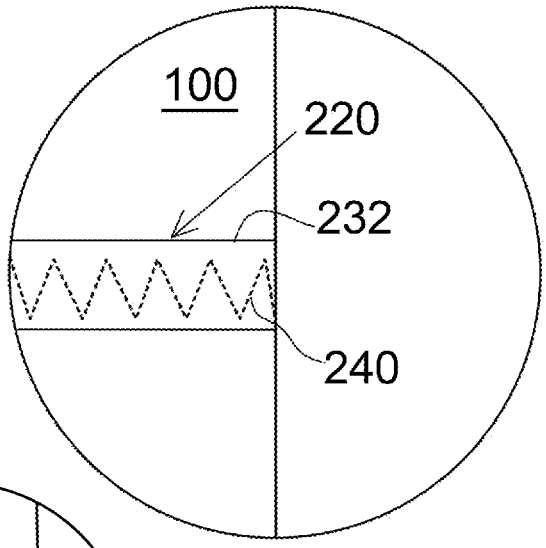
FIG.15d
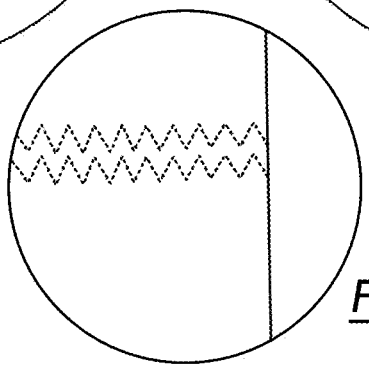
FIG.15e

WASTE TRANSFER AND DISPOSAL SYSTEM FOR BAGLESS VACUUM CLEANERS

CROSS REFERENCE TO RELATED APPLICATIONS

This application is a Continuation-in-Part of pending U.S. Non-Provisional application Ser. No. 13/757,765 titled: "WASTE TRANSFER AND DISPOSAL SYSTEM FOR BAGLESS VACUUM CLEANERS" filed Feb. 2, 2013, which claims the benefit of U.S. Provisional Application 61/703,324, and having the same title, with a filing date of Sep. 20, 2012.

FIELD

The present invention relates generally to a disposal system for vacuumed dust and debris using sealable bags.

BACKGROUND

Bagless vacuum cleaners are increasingly popular for a variety of reasons which include the ability to visually inspect vacuumed contents, and the ability of the vacuum cleaner to maintain suction even when the dust and debris canister is full. Such vacuum cleaners however, can be messy when emptied. Dust and debris can become compacted in the vacuum cleaner. Agitating the vacuum cleaner vigorously over a waste bin in order to free the contents only makes matters worse by inducing fine particles of dust; some under 1 micron, to become airborne. Allergic sensitization, allergic reactions, exacerbation of asthma, and other health problems can be triggered by such airborne dust. It would be desirable to provide a disposal system that avoids spreading dust and debris.

SUMMARY

The present invention relates generally to a system for the collection and containment of vacuumed dust and debris, and more particularly to waste disposal bags for placement over a portion of a dust collection canister of a bagless vacuum cleaner when the canister has been detached from the vacuum cleaner, and into which the waste contents of the dust collection canister of the vacuum cleaner are emptied. In particular embodiments presented herein, when a bag opening encircles the portion of a dust collection canister of a vacuum cleaner, a tightening means for cinching the bag such that it stays connected to the dust collection canister can be transversely applied across or around the bag. The tightening means can be a tape strip which partly or wholly encircles the bag, rubber banding partly or wholly encircling the bag, or any elastomeric or adhesive material partly or wholly encircling the bag. One embodiment described herein possesses a section of tape that is transversely applied across a bag that has been partially folded against itself once it is mounted to a dust collection canister of a vacuum cleaner. The tape secures the fold and serves to restrict the bag opening encircling a waste containing portion of the bagless vacuum cleaner which is either connected to (in situ), or separated from the vacuum cleaner. Once waste has been transferred from the dust collection canister, the bag is separated therefrom, and the bag opening is sealed by pulling a portion of the opening having a section of pressure sensitive adhesive, over the bag opening.

In one aspect of the present invention, a bag opening 200 possesses both a projecting portion and a relatively less projecting portion. On the inner facing side of the projecting portion is at least one, and preferably two light-tack adhesive bands which are exposed by peel-away strips. Prior to applying the bag to a waste container of a vacuum cleaner, one of two adhesive bands on the projecting portion is exposed by removing a peel-away strip. When pulling the bag opening over the dust collection canister, one of the exposed light-tack adhesive bands is pressed against the body of the dust collection canister. To completely encircle the dust collection canister, the bag is folded against itself as shown in FIG. 6, and adhesive strap 270*c* is placed across the fold lines 231 to cinch the bag opening about the waste container. When waste transfer is complete, (1) the previously applied light-tack adhesive band is separated from the bag, (2) the bag is detached from the dust collection canister, (3) a second adhesive band on the projecting portion is exposed, and (4) the projecting portion is folded over and adhered to portions of the bag adjacent the non-projecting portion.

In another aspect of the present invention, a waste transfer and disposal bag has an opening that is flared somewhat like a funnel with an elasticized waist below the opening. The flared portion is grasped by a user in order to pull the elasticized waist over a portion of a dust collection canister of a vacuum cleaner. The elasticized waist receives, and fully encircles a dust collection canister; typically that portion which leads to—or is attached to the vacuum cleaner output or dust chute, to prevent dust from escaping and becoming airborne. A bag sealing means includes an adhesive strip exposed by a peel-away backing on a portion of the flared opening which is pressed against another portion of the bag in order to seal the opening.

In yet another aspect of the present invention, an elasticized waist resides below the bag opening, producing a flared section comprised of projecting and non-projecting portions which are grasped by a user in order to pull the elasticized waist over a portion of a dust collection canister for emptying of vacuumed contents. When the waste transfer is complete, the bag is separated from the dust collection canister and a sealing means including an adhesive strip, preferably on a surface of the projecting portion, is folded over and adhered to portions of the bag adjacent the non-projecting portion.

The waste disposal bag of the present invention can include a handle or handles which comprise any portion of the bag extending above the bag opening.

It will be appreciated by those of ordinary skill in the art that elastic or inelastic bands, flat bands constructed of paper or other material having adhesive portions extending transversely over fold lines or gathers produced when bunching or reducing the bag opening to snugly encircle a waste container can be employed without departing from the spirit and scope of the present invention. Those having ordinary skill in the art will appreciate that the body of the waste transfer and disposal bag can be any material such as plastic, paper, plastic and paper laminates, non-woven synthetics, biodegradable compositions, or any combination of the foregoing, and whether of single or multiple ply construction. Bags can be produced with or without gussets. Bag manufacture can employ among other processes, blow molding, heat sealing, sonic welding, folding, laminating and gluing together at seams, if any are present.

It will be appreciated by those of ordinary skill in the art that any elastic material such as flat or cylindrical bands, elastic thread with lycra or other suitable material, whether natural or synthetic, can be used to produce the elasticized waist of the bag without departing from the spirit and scope of the present invention. Elastic stitching can be applied over circumferential elastic banding to attach the banding to the plastic bag, or elastic materials can be bonded directly to the bag through adhesive means which can include spray application of an elastomer over the elastic materials. The elastic elements can be bonded to the bag in various ways, such as the exemplary methods enumerated in U.S. Pat. No. 6,921,202 to Raterman, which is incorporated herein by reference in its entirety, or by elastic elements sandwiched between relatively non-elastic regions of the bag to constrict the bag opening. One method of attaching a rubber band circumferentially about a bag is to place the bag over a supportive frame that will maintain the bag in a flattened aspect and attach an elastic element to the outer surface of the bag using any suitable attachment means, whether by gluing, heat bonding or by stitching the elastic element to the bag. In any case, it is not intended that this disclosure limit the present invention to any one means of producing an elastic waist for fitting over and conforming to a portion of a vacuum cleaner.

The foregoing and other objects, features, and advantages of the invention will become more apparent from the following detailed description, which proceeds with reference to the accompanying figures wherein the scale depicted is approximate.

BRIEF DESCRIPTION OF THE DRAWINGS

FIG. 7 in a view taken from projecting side 210, shows the embodiment of (FIGS. 1-6) attached to a waste containing portion of a bagless vacuum cleaner;

FIG. 8 in a view taken from lower side 211, shows the embodiment of (FIGS. 1-6) attached to a waste containing portion of a vacuum cleaner;

FIG. 9 is a view taken from projecting side 210, of the waste and debris exiting the waste container of a vacuum cleaner into the bag;

FIG. 15*a* shows an exemplary method of forming an elasticized waist about the waste transfer and disposal bag according to the present invention;

FIG. 15*b* shows another exemplary method of forming an elasticized waist about the waste transfer and disposal bag according to the present invention;

FIG. 15*c* shows still another exemplary method of forming an elasticized waist about the waste transfer and disposal bag according to the present invention;

FIG. 15*d* shows yet another exemplary method of forming an elasticized waist about the waste transfer and disposal bag according to the present invention;

FIG. 15*e* shows yet another exemplary method of forming an elasticized waist with multiple rows of elastic material such as threading, banding or flocking, about the waste transfer and disposal bag that are printed on, stitched, glued, fused, sonically welded, laminated, or otherwise applied to the bag to produce a constricting effect when the bag opening is placed over a part of a vacuum cleaner;

DETAILED DESCRIPTION OF THE INVENTION

Figure 1:
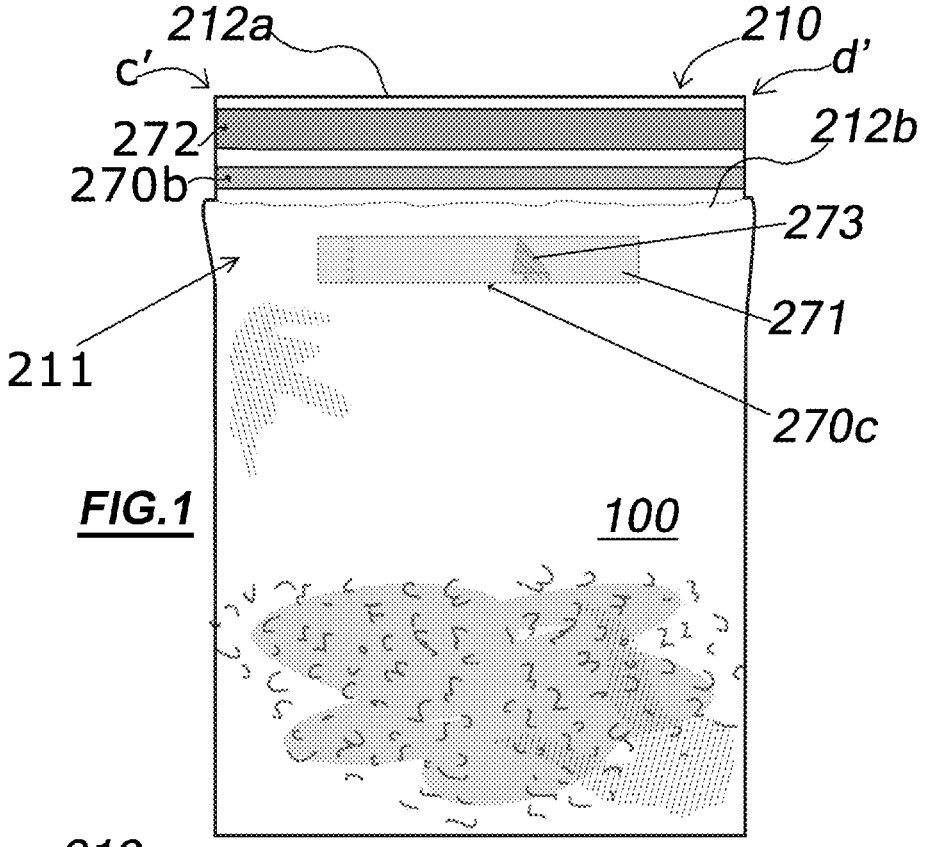
FIG. 1 is a plan view of one embodiment of a waste transfer and disposal bag according to the present invention in which the body of the bag has been flattened to show the upper projecting portion 210 with upper lip 212*a*, and the lower portion 211 bordered by lip 212*b;*

Reference listing:

100 bag
200 opening
210 projecting portion
211 lower portion
212*a* upper lip
212*b* lower lip
220 elasticized waist
230 gather
231 fold line
232 overlay
240 elastic element
250 gusset
270 adhesive strip
270*a* upper adhesive band
270*b* lower adhesive band
270*c* cinching adhesive strap
270*d* adhesive strip
271 release strip
272 peel-away strip
273 tab
280 handle
300 vacuum cleaner
400 debris

Definitions

In the following description, the term "bag" refers to a bag which is sized and shaped for placement over a waste containment portion, or waste container, of a bagless vacuum cleaner. Bagless vacuum cleaners typically possess a waste and debris canister with or without an access flap for emptying vacuumed waste. The bag of the present invention is sized and shaped to accept, encircle, and conform to at least a waste containing portion of a bagless vacuum cleaner when separated from the vacuum cleaner. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word 'or" is intended to include "and" unless the context clearly indicates otherwise. Although methods and materials similar or equivalent to those described herein can be used in the practice or testing of this disclosure, suitable methods and materials are described below. The term "comprises" means "includes." Any object, aspect or feature of any one embodiment can be added to any other embodiment without departing from the scope of the invention. All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting.

Referring generally to FIGS. 1-29, a transfer and disposal system for dust and debris which is particularly suited for bagless vacuum cleaners includes bag 100 with opening 200 having a projecting portion 210 terminating in upper lip 212*a*, and a non-projecting portion terminating in a lower lip 212*b*. Gathers 230 or fold lines 231 may be produced about the bag circumference whereby the opening diameter is reduced in order to encircle and conform to a portion of a bagless vacuum cleaner 300.

Turning to FIGS. 1-12 a preferred embodiment includes a cinching means comprising an adhesive band that is affixed over fold lines of the bag once the bag diameter has been reduced. When the dust collection canister of a vacuum cleaner and bag are coupled, dust and debris contained in the vacuum cleaner are transferred to the bag. Once the bag and dust collection canister of the vacuum cleaner are separated, in part by un-cinching the bag, a bag sealing means is provided comprising at least one adhesive band area which is preferably on the projecting portion 210 of the bag which is folded over the bag opening.

Figure 2:
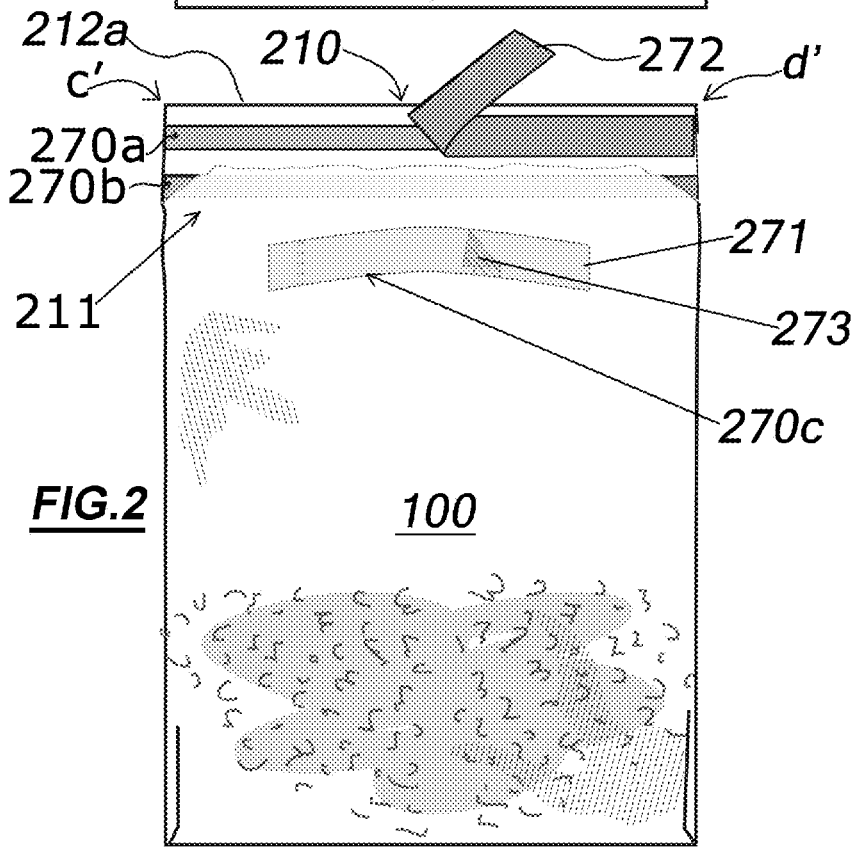
FIG. 2 is a plan view of the embodiment shown in (FIG. 1) after filling with debris and separated from a waste container, in which lower lip 212*b* is pulled up over lower adhesive band 270*b,*
Figure 3:
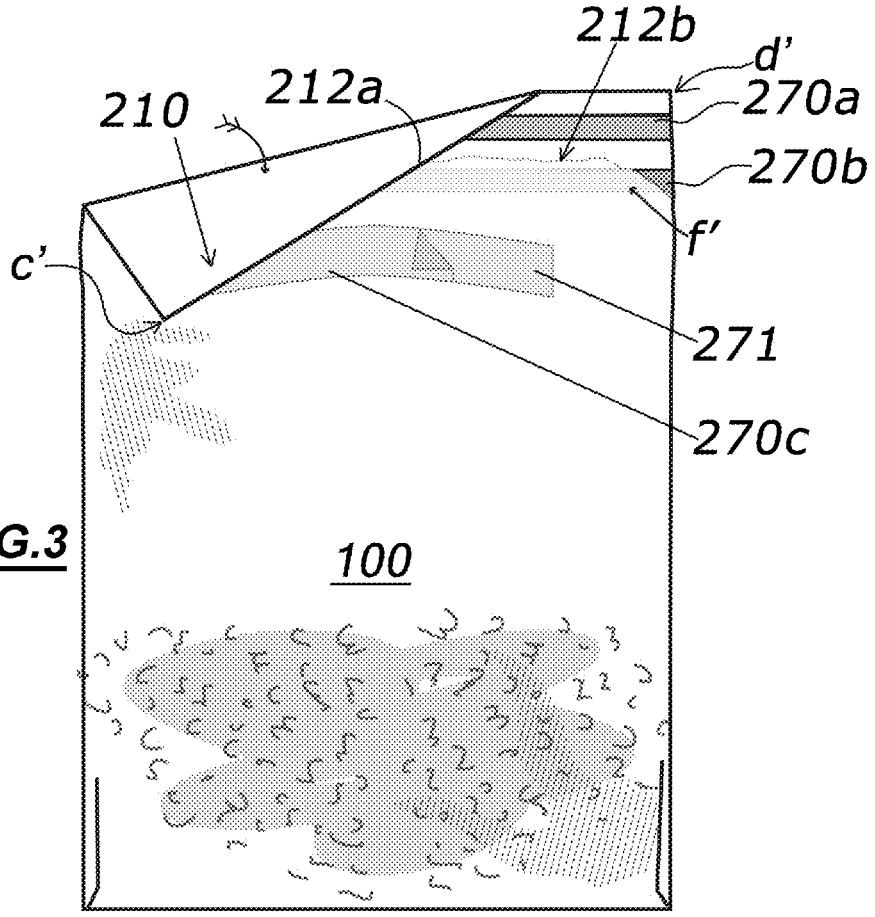
FIGS. 3 and 4 are sequential plan views of one sealing operation for the embodiment shown in (FIG. 2) after filling with debris and separated from a waste container, in which a corner of the projecting portion 210 is pulled over exposed adhesive band area.
Figure 4:
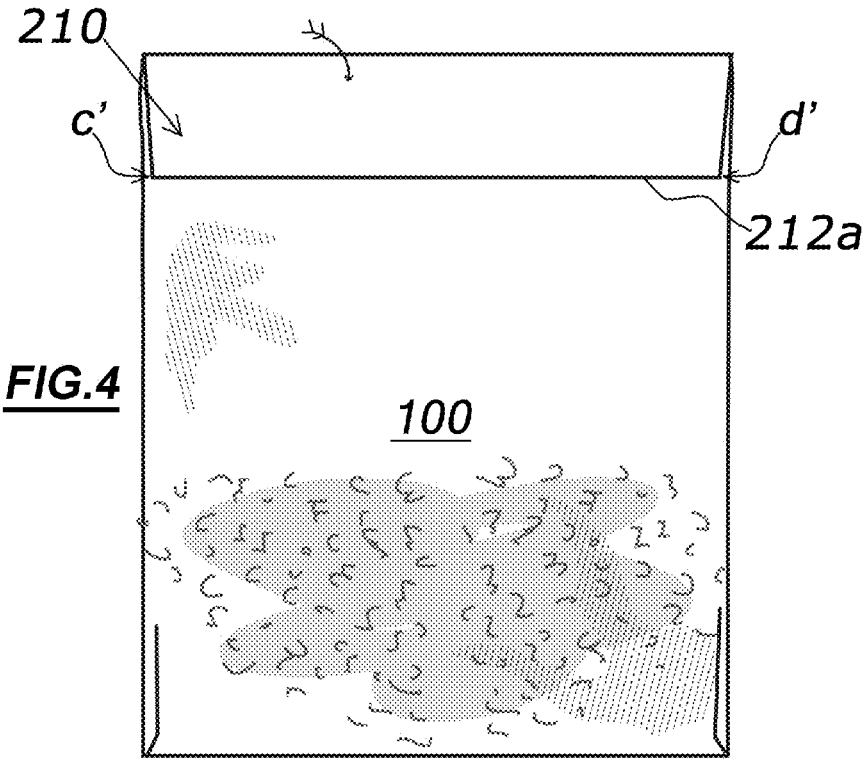

FIG. 1 is a plan view showing projecting portion 210 and lower portion with lip 212*b*. Two adhesive bands; upper band 270*a*, and lower band 270*b* are covered with peel-away strips 272. A third adhesive strip 270*c* has an adhesive face toward release strip 271 which is similar to the peel-away strips 272 and permanently attached to the bag body. FIG. 2 is a plan view of the embodiment shown in (FIG. 1) after filling with debris and separated from a waste container, in which lower lip 212*b* is pulled up over lower adhesive band 270*b*, thus forming a first seal of the bag opening. FIGS. 3 and 4 are sequential views of one sealing operation for the embodiment shown in (FIG. 2) after it is filled with debris and separated from a waste container, and in which a corner c' of the projecting portion 210 is pulled over to adhere exposed adhesive band area to the bag body.

Figure 5:
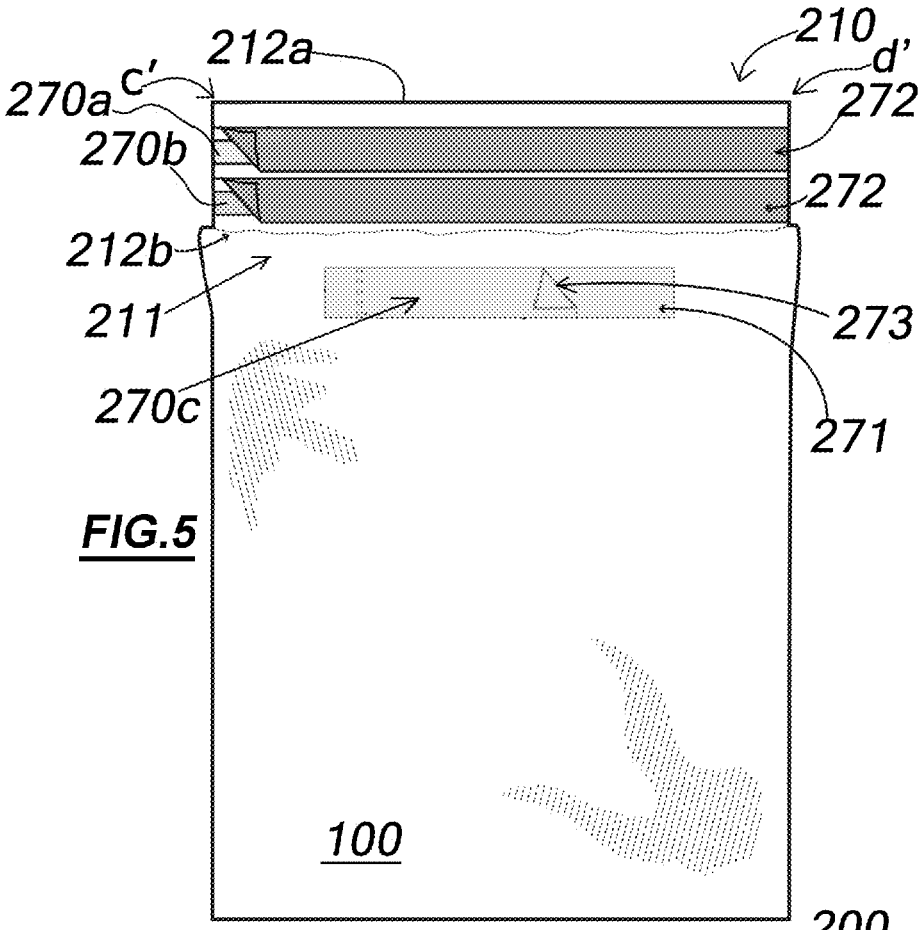
FIG. 5 is a plan view of an embodiment of a waste transfer and disposal bag according to the present invention in which the body of the bag has been flattened to show the upper projecting portion 210 with adhesive band 270*a*, 270*b* which are exposed via peel-away strips 272, upper lip 212*a*, and the lower portion 211 bordered by lip 212*b;*
Figure 6:
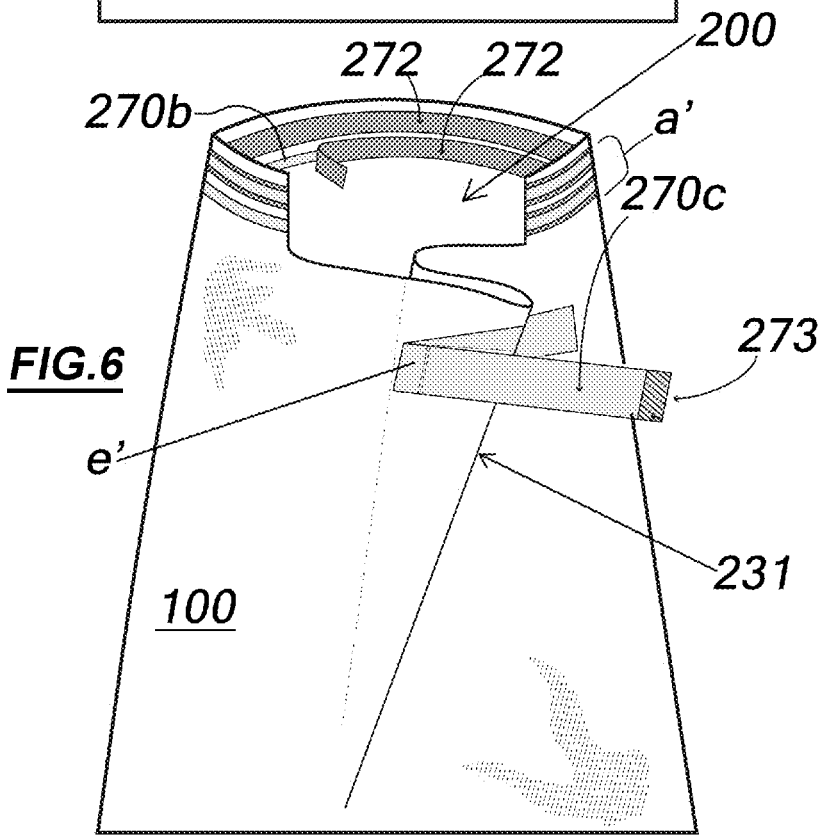
FIG. 6 depicts a preparatory step prior to attaching waste disposal bag 100 to a portion of a vacuum cleaner in which the lower adhesive band is exposed by peeling away strip 272, and the bag is partially folded over itself to reduce opening 200.

FIG. 5 is a plan view of an embodiment of a waste transfer and disposal bag according to the present invention in which the body of the bag has been flattened to best show the upper projecting portion 210 with adhesive bands area, 270*a*, 270*b* which are exposed via peel-away strips 272, upper lip 212*a*, and the lower portion 211 bordered by lip 212*b*. FIG. 6 depicts a step prior to attaching waste disposal bag 100 to a portion of a vacuum cleaner in which lower adhesive band 270*b* is exposed by peeling away strip 272, and the bag is then partially folded 231 over itself to reduce opening 200.

FIGS. 7-9 show one exemplary configuration for coupling bag 100 to a bagless vacuum cleaner. FIG. 7 shows the projecting portion 210 with adhesive strips facing the vacuum cleaner. Strip 270*b* can been exposed to adhere to the vacuum cleaner's surface. FIG. 8 shows the configuration from side opposite (FIG. 7), and depicts a portion of the bag folded 231 over itself to shape and size the opening 200 to the particular vacuum cleaner. Adhesive strap 270*c* is placed across fold line 231 to cinch the opening about the vacuum cleaner. FIG. 9 shows waste 400 transferred from the vacuum cleaner dust container to the bag.

Figure 10:
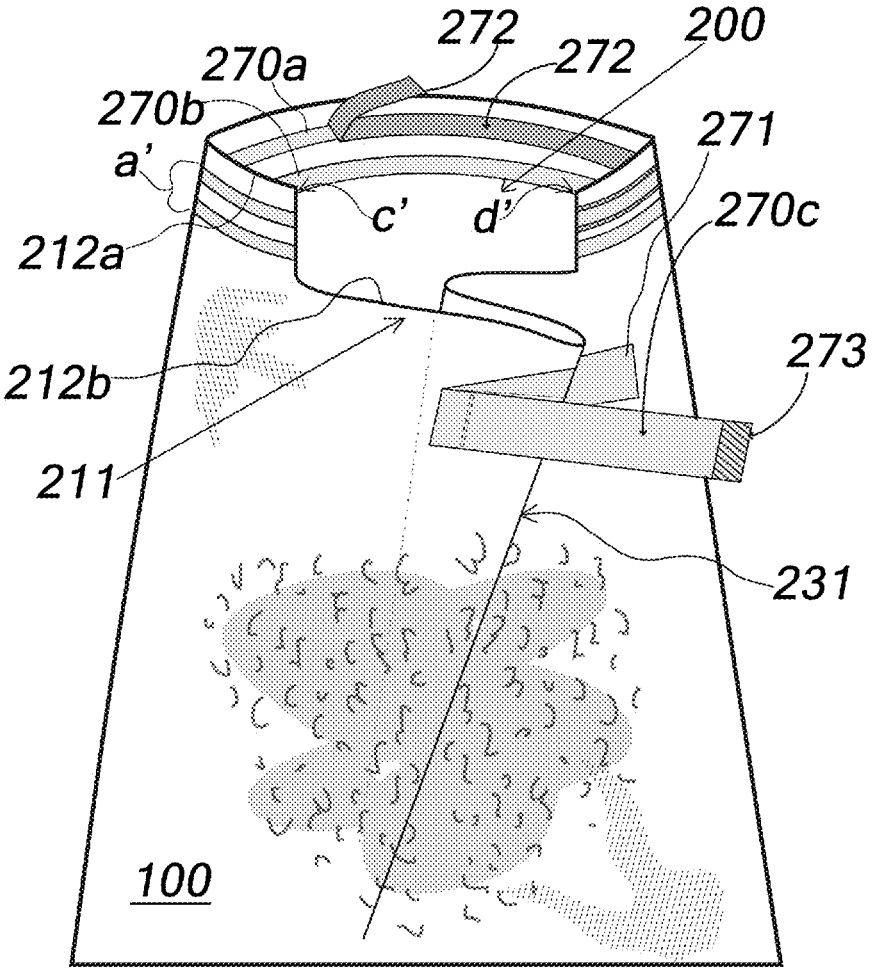
FIG. 10 depicts the bag having been removed from the vacuum cleaner with peel away strip 272 being removed from top adhesive band area in preparation for bag sealing.

FIG. 10 shows adhesive strip 270*b* having been detached from the bag in order to disconnect the bag from the vacuum cleaner. Peel-away strip 272 is removed to expose the top adhesive band area in preparation for sealing.

Figure 11:
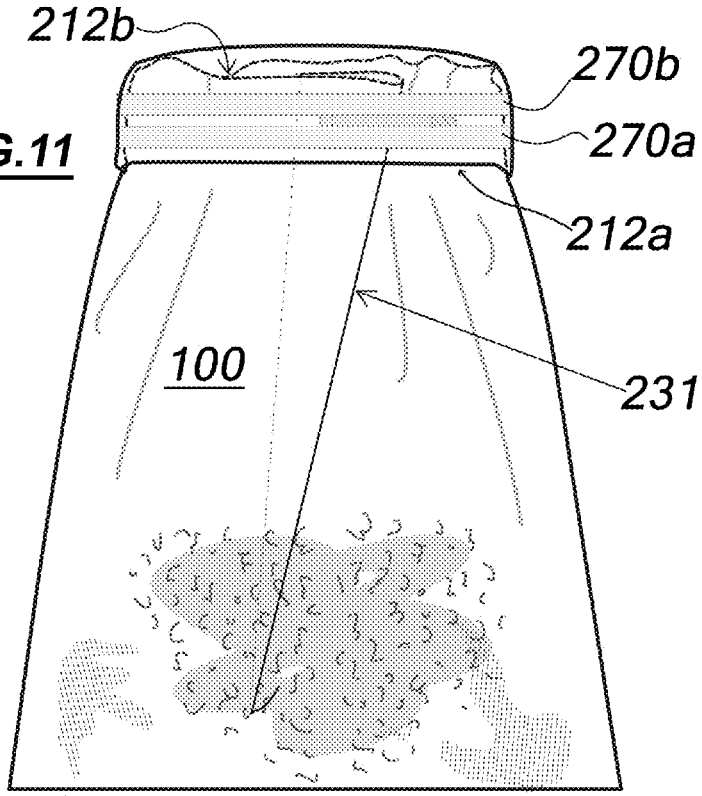
FIGS. 11 and 12 are plan views of the embodiment shown in (FIGS. 1-6) illustrating an alternative sealing operation, and showing respectively, flap 210 folded over top opening to seal the bag, and the reverse side of (FIG. 11) showing corners c' and d' wrapped around the bag and brought together.
Figure 12:
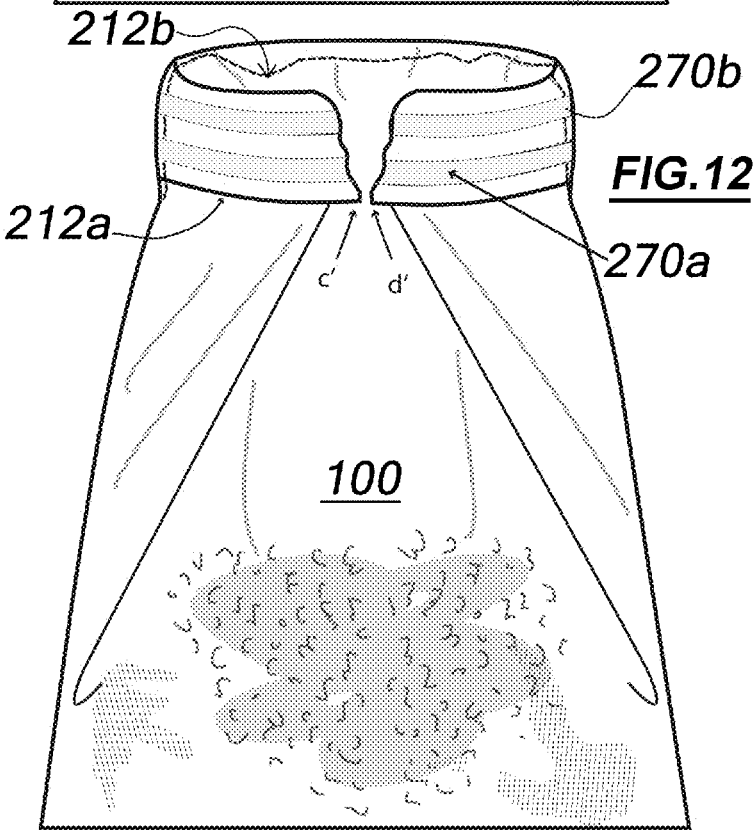

FIGS. 11 and 12 in one sealing configuration, shows a first side of the bag in which (1) the top lip of the projecting portion is pulled over to occlude the opening 200, and on the opposite side, (2) corners c' and d' are wrapped around the bag and brought together. Note that dotted lines in FIGS. 11 and 12 represent lower lip 212*b* beneath projecting portion 210.

Turning to FIGS. 13-16*d* and 18-19, a transfer and disposal system for dust and debris includes bag 100 with opening 200 having a projecting portion 210 terminating in upper lip 212*a*, and a non-projecting portion terminating in lower lip 212*b*. An elasticized waist 220 in a relaxed state forms gathers 230 about the bag circumference whereby the opening diameter is reduced, and in a stretched state allows the waist to encircle and conform to a portion of a bagless vacuum cleaner 300. When the vacuum cleaner and bag are coupled, dust and debris contained in the vacuum cleaner are transferred to the bag. Once the bag and vacuum cleaner are separated, a sealing means is provided comprising an adhesive strip which is preferably on the projecting portion of the bag.

Figure 13:
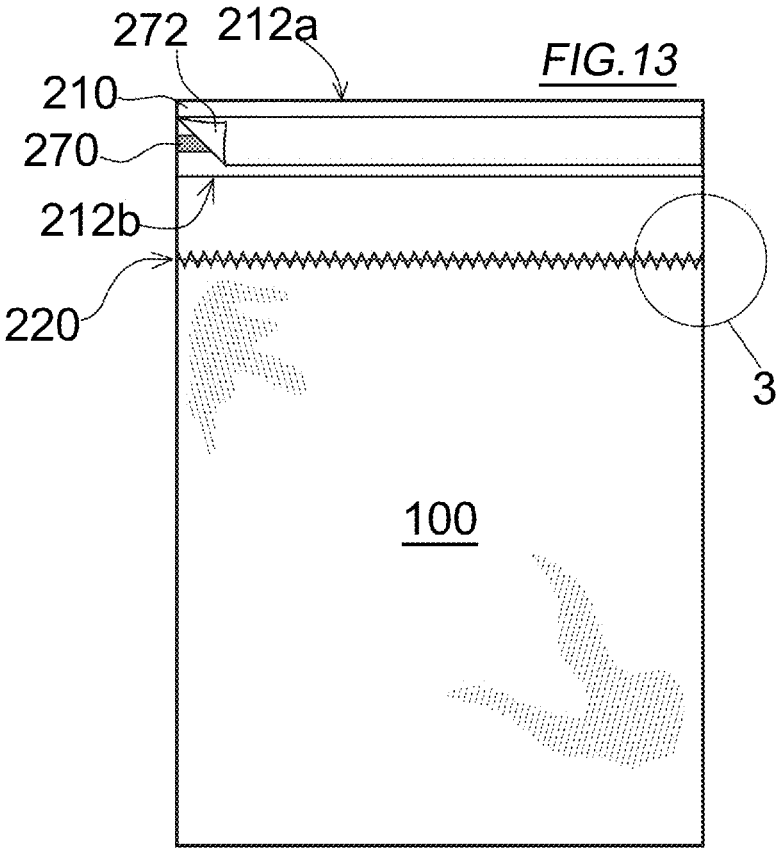
FIG. 13 is a plan view of a waste transfer and disposal bag according to the present invention in which the body of the bag has been flattened and stretched to show the position of an elasticized waist, indicated by the zig-zag lines.
Figure 14:
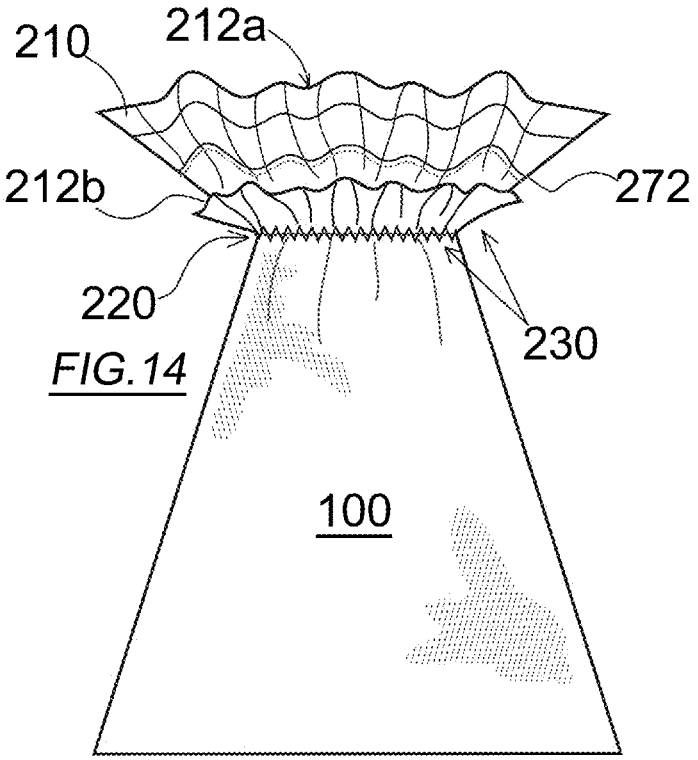
FIG. 14 shows the bag of (FIG. 13) in which the elasticized waist is relaxed, constricting the bag and forming gathers.

FIG. 13 depicts a waste transfer bag with an elasticized waist portion 220. It should be understood that the FIG. 13 does not represent a typical relaxed state of the bag, but schematically shows the relative positions of the bag elements as if the bag were stretched and flattened, such as between two panes of glass. Once the circumferential elasticized waist is applied, the bag assumes the relaxed state shown in FIG. 14. The elasticized waist produces gathers in immediately adjacent sections, and a flaring above the waist. Regarding FIG. 14, it should be noted that the grid pattern shown on projecting portion 210 is a visual device to help distinguish the projecting portion form the lower portion. Both portions are flared and together (1) serve as a guide to inserting a portion of a vacuum cleaner and (2) provides a user with easily gripped regions for positioning the waist 220 over a dust containment portion of a vacuum cleaner. Regarding the flared portion, the projecting and non-projecting portions transition from one to the other, and are therefore contiguous.

FIGS. 15*a*-15*d* show various exemplary methods for producing an elasticized waist 220. In FIG. 15*a*, a flat elastic element 240, is attached to the inside or outer surface of the bag by stitching which is indicated in the broken zig-zag pattern. FIG. 15*b* shows a zig-zag pattern formed by a bonded elastic element(s) such as a cylindrical rubber strands arranged in a zig-zag pattern which can be heat bonded or otherwise adhered to the bag circumference by glue or spraying a coating of an elastomer over the strands. FIG. 15*c* shows a flat elastic band shown in dotted line on the outer surface of the bag, yet beneath an strip overlay 232 bonded to the bag's surface which secures the elastic member to the bag. Likewise, FIG. 15*d* shows a zig-zag pattern formed by an elastic strand shown in dotted line beneath an applied strip overlay. The overlay can be the same material as the bag body, such as polyethylene or cellophane which is glued or heat sealed over the elastic element. While it is preferable that the elastic elements completely encircle the bag to form a continuous waist, the elastic elements and bonding means can be applied in multiple non-connecting sections about the circumference of the bag.

Figure 16A:
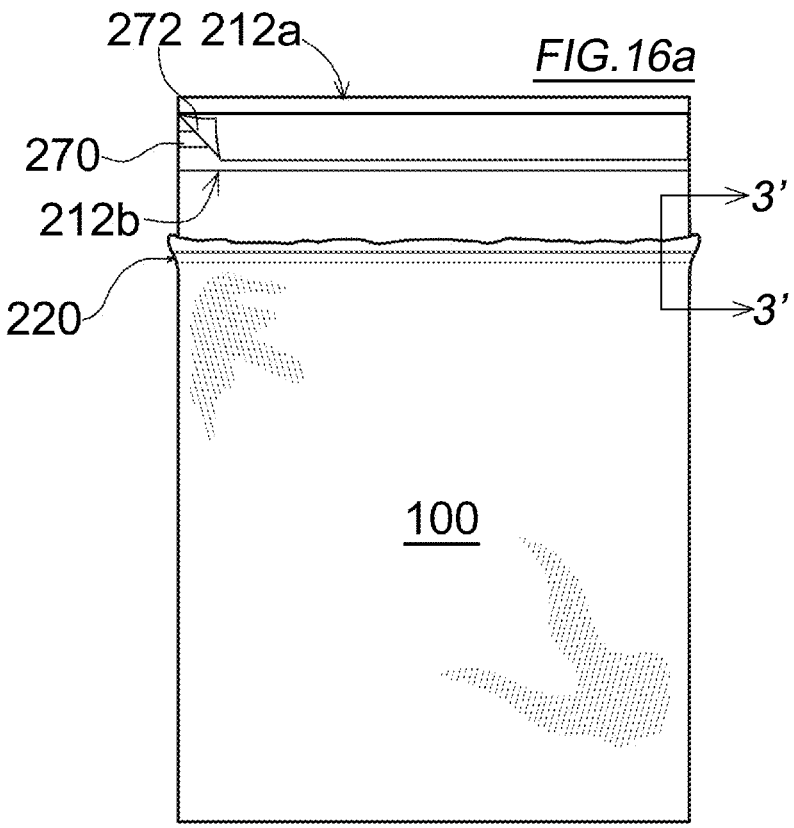
FIG. 16*a* is a plan view of a waste transfer and disposal bag according to the present invention in which the body of the bag has been flattened and stretched to show the relative position of elasticized waist 220, in which elastic element 240 is a flat elastic band circumferentially affixed to the bag.
Figure 16C:
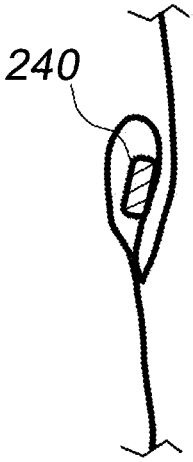
FIGS. 16*c* and 16*d* show a portion of the bag doubled against itself and stitched or heat sealed to form a channel for an elastic element.
Figure 16D:
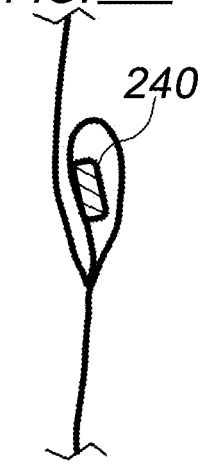
Figure 16B:
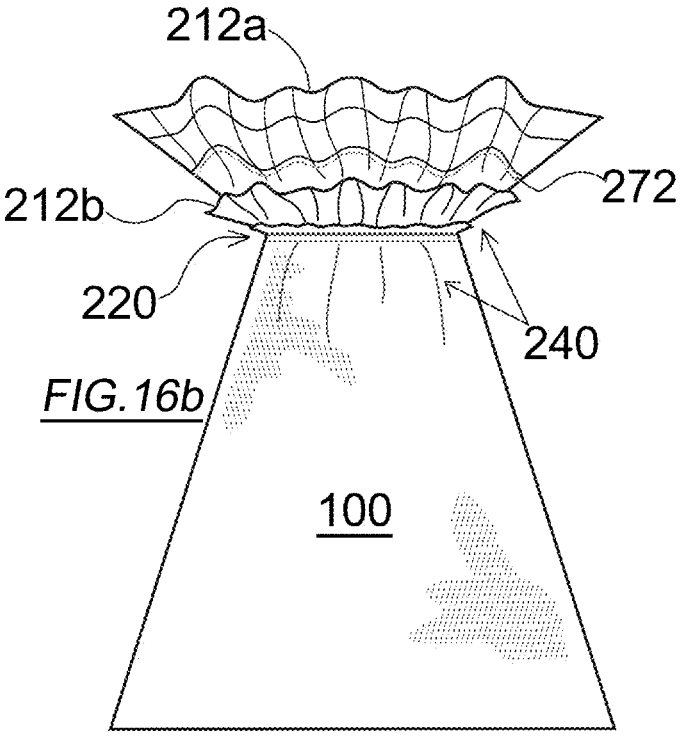
FIG. 16*b* shows the bag of (FIG. 16) in which the elasticized waist is relaxed, constricting the bag and forming gathers.

FIG. 16*a* shows waste disposal bag 100 in a flattened aspect possessing a flat elastic member 240 which can be one or more elastic elements, such as rubber bands about the circumference of the bag producing an elasticized waist 220. FIG. 16*b* shows the bag of (FIG. 16*a*) in a relaxed state producing a constricted waist. Regarding FIG. 16*b*, the grid pattern shown on projecting portion 210 is a visual device to help distinguish the projecting portion 210 from the lower portion. FIG. 16*c* is a cross-sectional view taken along lines 3'-3' of FIG. 16, depicting a possible configuration for the elasticized waist in which a portion of the bag is doubled back and adhered to itself to form a channel resembling a casing for the elastic element. FIG. 16*d* is another possible configuration showing the channel formed on the inside of the bag.

Figure 17A:
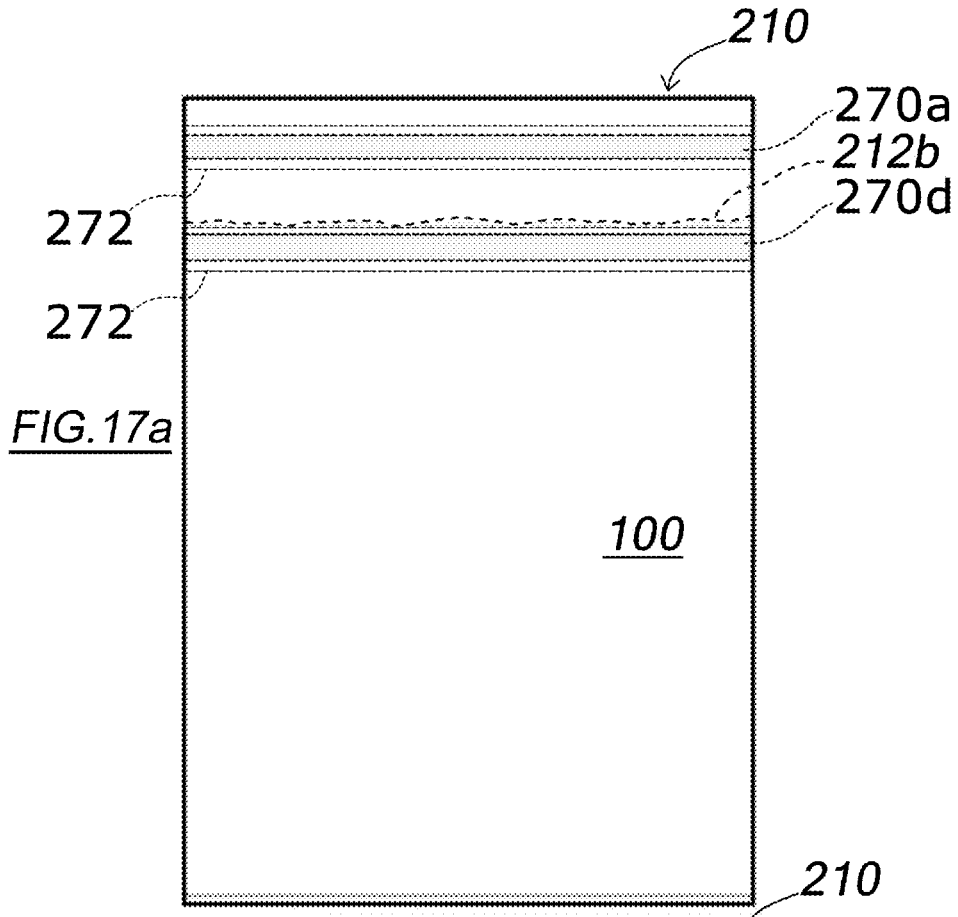
FIGS. 17*a* and 17*b* show respectively the front and back sides of another embodiment of a waste transfer and disposal bag having two adhesive strips, one superior to the lip 212*b* on the projecting portion 210, and one just below the lip 212*b*.
Figure 17B:
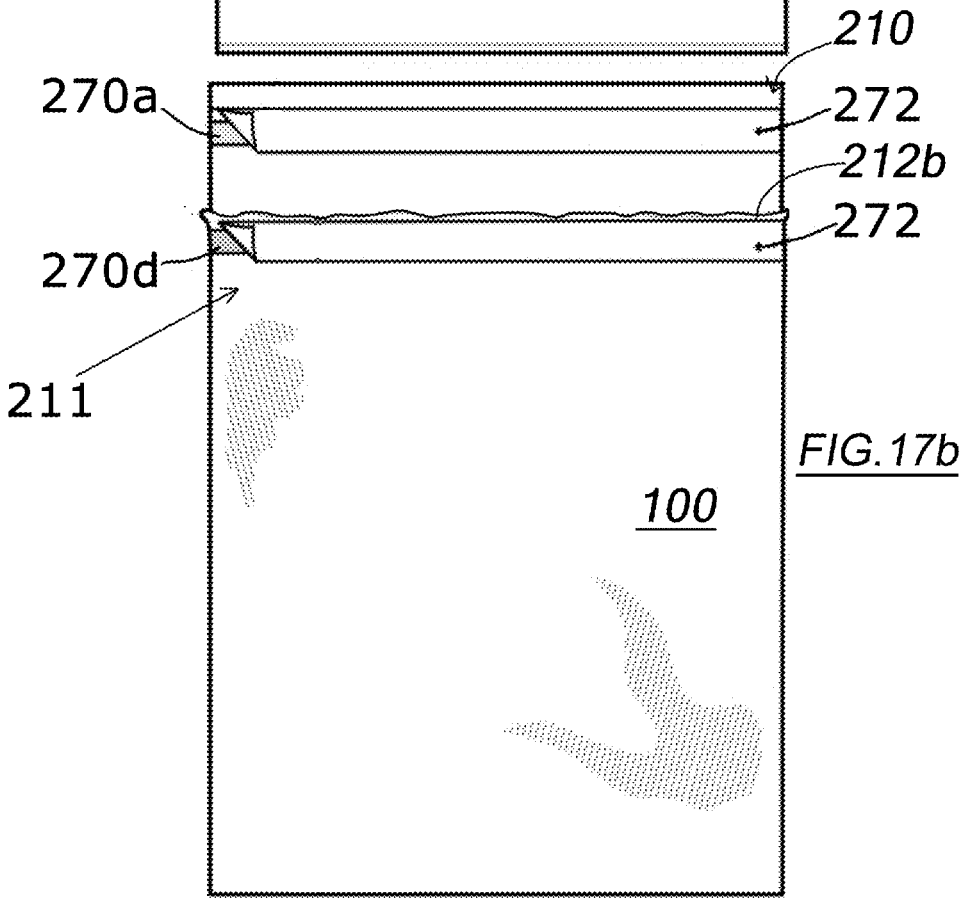

FIGS. 17*a* and 17*b* are front and back views of another embodiment of the waste transfer and disposal bag having an upper adhesive band with peel away backing and a lower adhesive band 270*d* just inferior to bag lower lip 212*b*. One method of use for the embodiment included the following steps:

Remove adhesive strip from projecting portion of the plastic bag; Adhere the adhesive to the front or back side of a dust chute of a vacuum canister above the drop lid opening;

Pull the bag opening over the bottom of the vacuum canister, covering the entire drop lid while the plastic bag remains attached to one side of the vacuum canister;

Remove adhesive strip from the non-projecting portion of the plastic bag;

Fold the adhesive toward the inside to adhere the plastic bag to the opposite side of the vacuum canister, above the drop lid, sealing as much of the plastic bag opening as possible;

Push the vacuum canister drop lid to open, transferring all the vacuum canister contents into the plastic bag;

Push the drop lid closed, pushing from outside the bag avoiding touching the soiled drop lid;

Remove one side of plastic bag adhesive from vacuum canister, and then remove the other side adhesive from vacuum canister;

Fold the projecting portion of the plastic bag over the bag top opening, securing the adhesives to the plastic bag, sealing it closed; and, Drop plastic bag in the household trash.

It should be understood that the foregoing method merely exemplary. Some of the steps provided above may be combined with other provided steps, and conversely, some of the provided steps may be divided into multiple steps.

Figure 18:
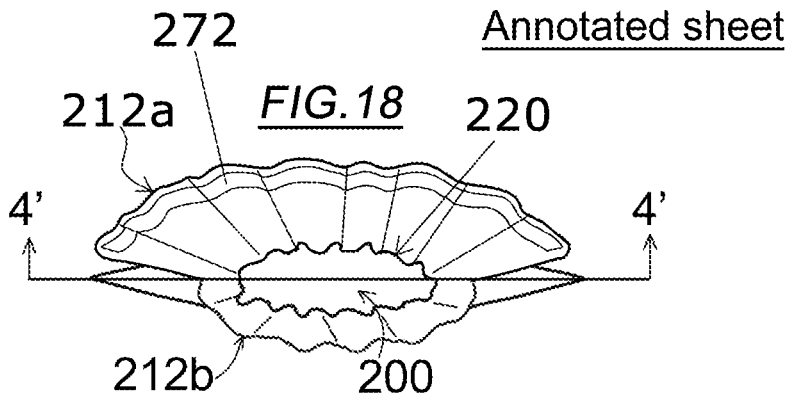
FIG. 18 is a longitudinal view looking directly into opening 200 of a waste and disposal bag according to the present invention.
Figure 19:
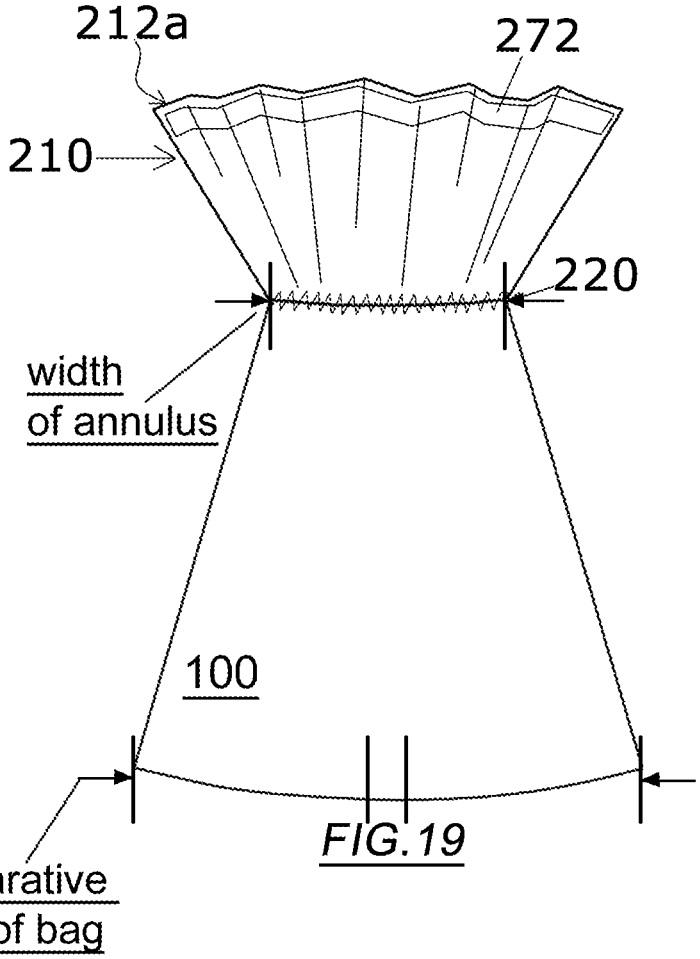
FIG. 19 is a cross-sectional view taken along lines 4'-4' of (FIG. 18) showing bag opening 200 having a lower non-projecting portion transitioning to projecting portion 210.

FIG. 18 is a view looking directly into the opening of a waste and disposal bag according to the present invention. FIG. 19 is a cross-sectional view taken along lines 4'-4' of (FIG. 18), and best shows projecting portion 210 as it relates to bag opening 200 and elasticized waist 220. The transition between upper and lower portions of the opening can be curved, or any transition profile between the respective portions of the opening possessing suitable tear resistance can be used.

Figure 20:
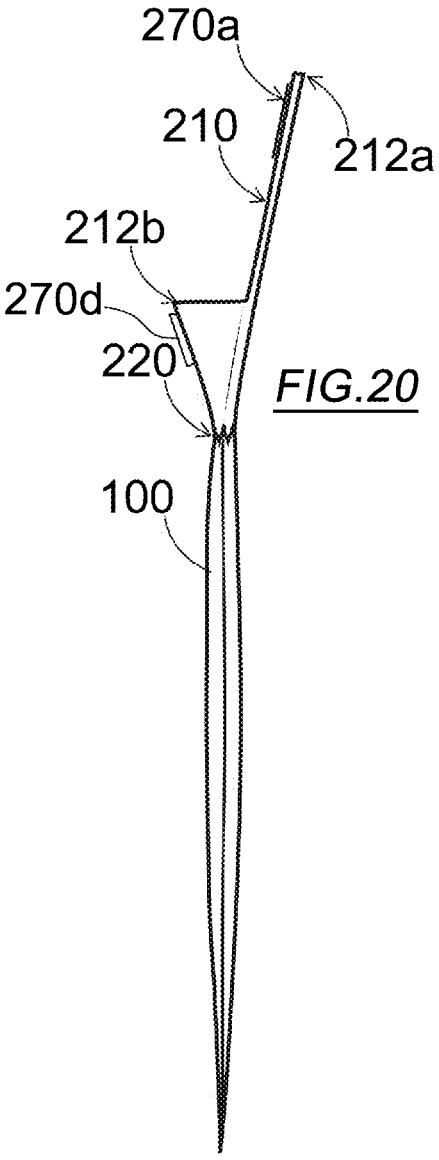
FIG. 20 is a side view of a waste transfer and disposal bag according to the present invention showing a flaring portion above the elasticized waist 220 of the bag.
Figure 21:
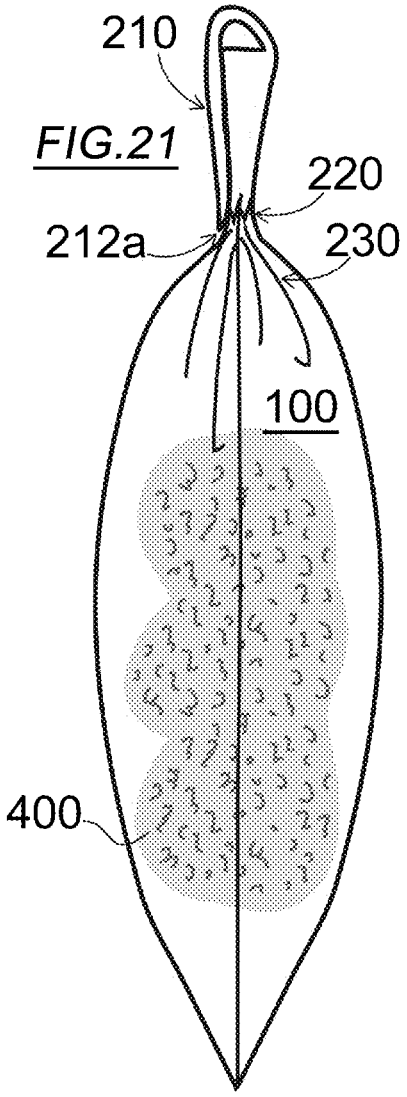
FIG. 21 is a side view of a filled waste transfer and disposal bag according to the present invention in which projecting portion 210 occludes the opening.

FIG. 20 and FIG. 21 are side views showing respectively, a waste transfer and disposal bag 100 before and after filling. While the projecting portion has an adhesive region 270 which is preferably covered by a peel-away strip (not shown), it is intended that the adhesive region can be of any size up to entirely covering a side of the projecting portion, or positioned on another portion of the bag adjacent lower lip 212*b*. After filling the bag, projecting portion 210 is folded over the opening. Although FIG. 21 shows a gap (at top) between the projecting and lower portions, this would not ordinarily be the case, because the projecting portion can adhere to any adjacent region of the bag and completely occlude the bag's opening.

Figure 22:
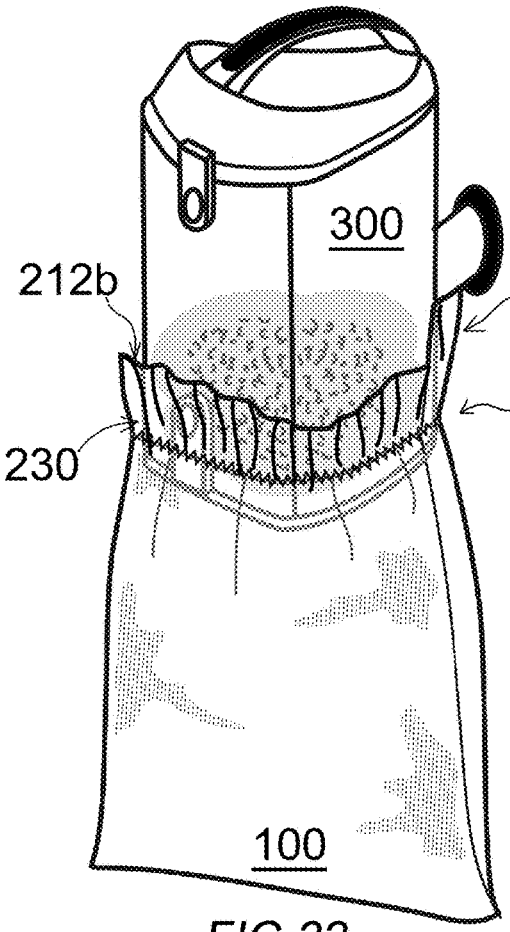
FIG. 22 depicts opening 200 and waist 220 of the waste transfer and disposal bag according to the present invention encircling a portion of a vacuum cleaner.
Figure 23:
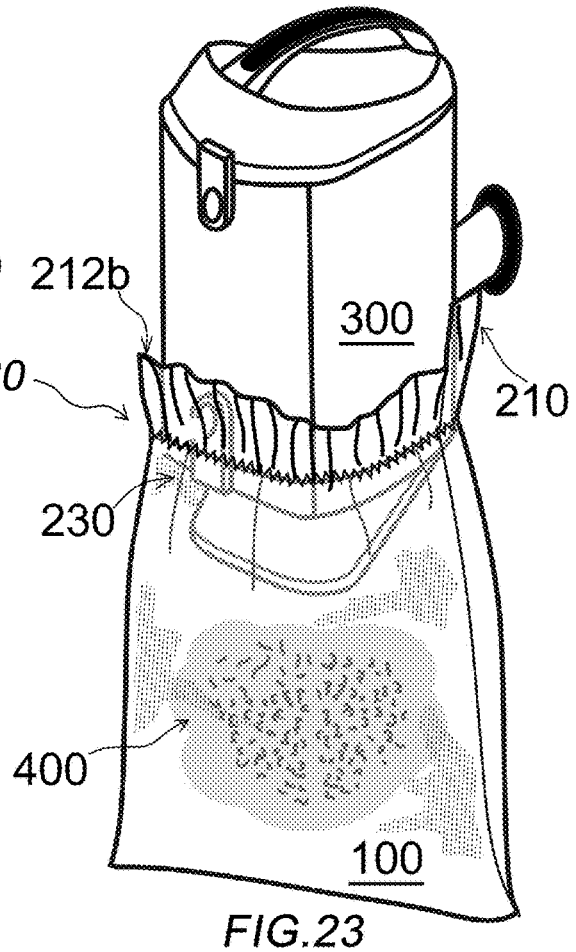
FIG. 23 shows the bag of (FIG. 22) with dust and debris transferred from the bagless vacuum cleaner.
Figure 24:
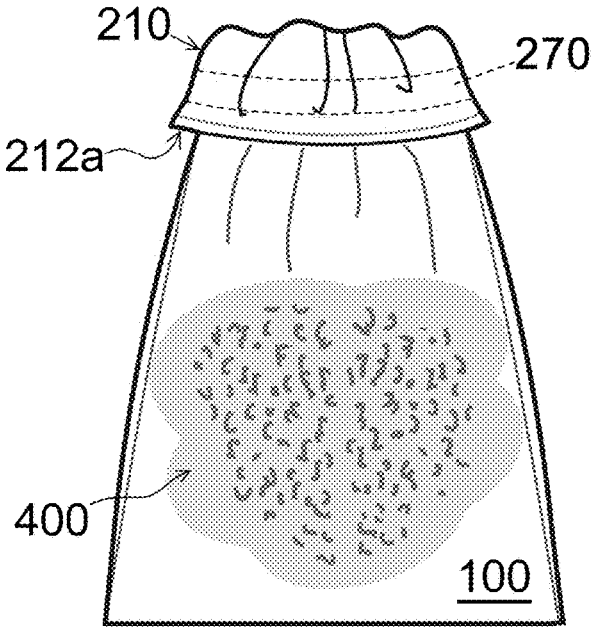
FIG. 24 is a front view of the bag shown in (FIGS. 22 and 23) with projecting portion 210 pulled over bag opening 200 and adhered to an opposite side of the bag.

FIG. 22 shows waste transfer and disposal bag 100 in which elasticized waist 220 has been pulled over an end of a waste filled bagless vacuum cleaner 300. In some vacuum cleaners a movable flap covers the waste compartment, while in others the waste compartment can be completely separated from the vacuum cleaner. In any case, the elasticized waist fits snugly over the vacuum cleaner or a portion thereof during waste transfer to contain spillage and airborne dust. FIG. 23 shows the bag with transferred waste from the dust containment portion of a vacuum cleaner. FIG. 24 shows the bag when separated from the vacuum cleaner and sealed.

Figure 25:
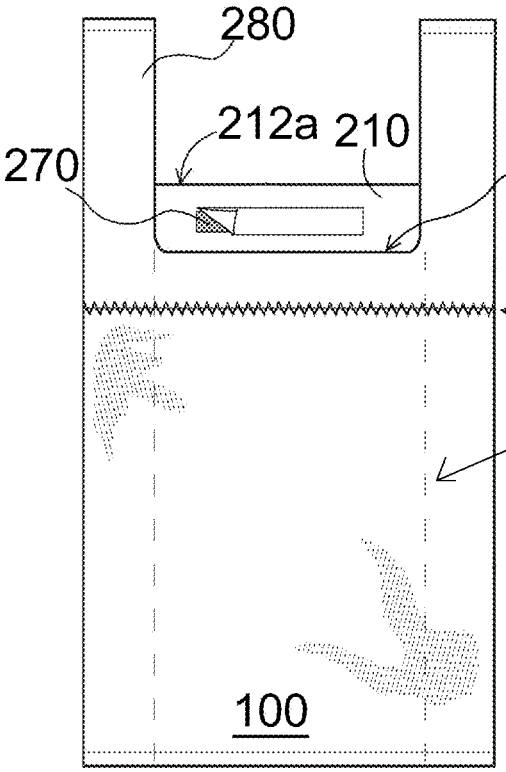
FIG. 25 is a plan view of a flattened and stretched waste transfer and disposal bag with handles according to the present invention.
Figure 26:
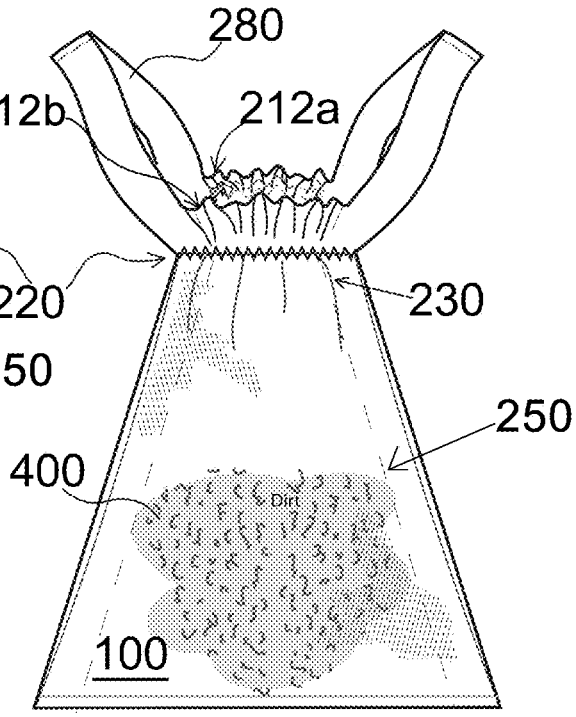
FIG. 26 shows bag of (FIG. 25) in a relaxed state.
Figure 27:
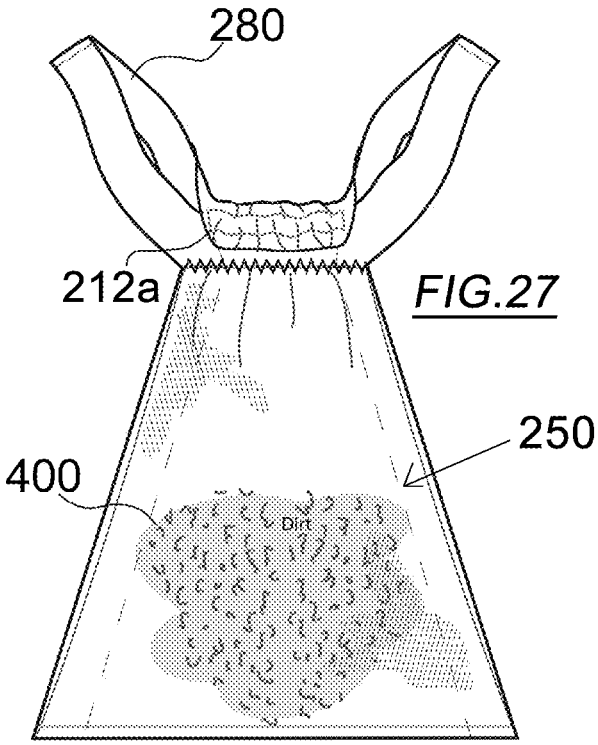
FIG. 27 shows bag of (FIG. 25) in a relaxed state with the projecting portion 210 with adhesive strip 270 pulled over and sealing the opening.
Figure 28:
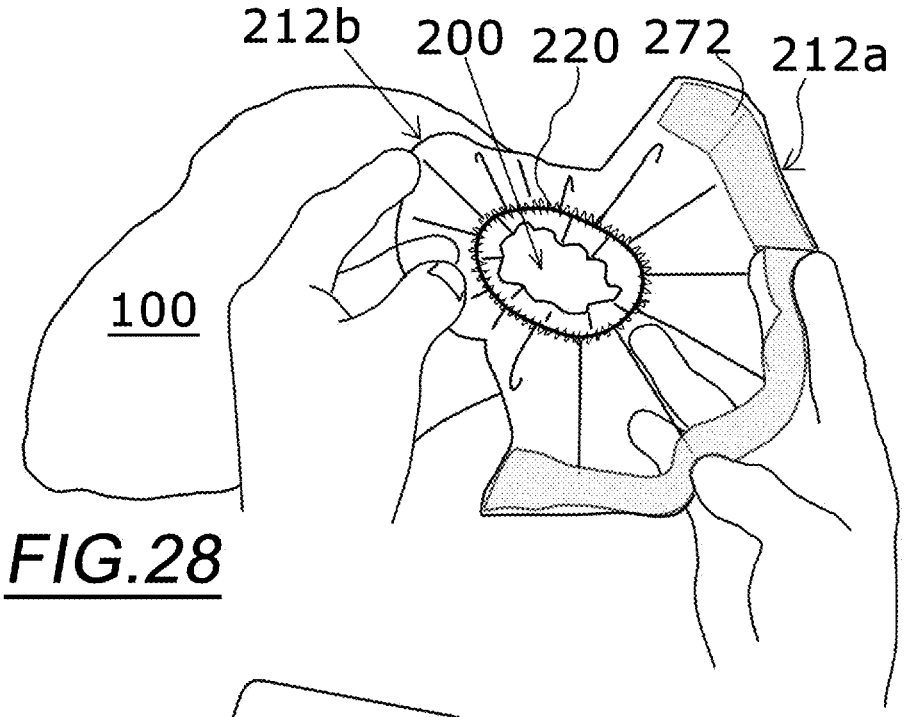
FIG. 28 shows bag being grasped by the flared portion.
Figure 29:
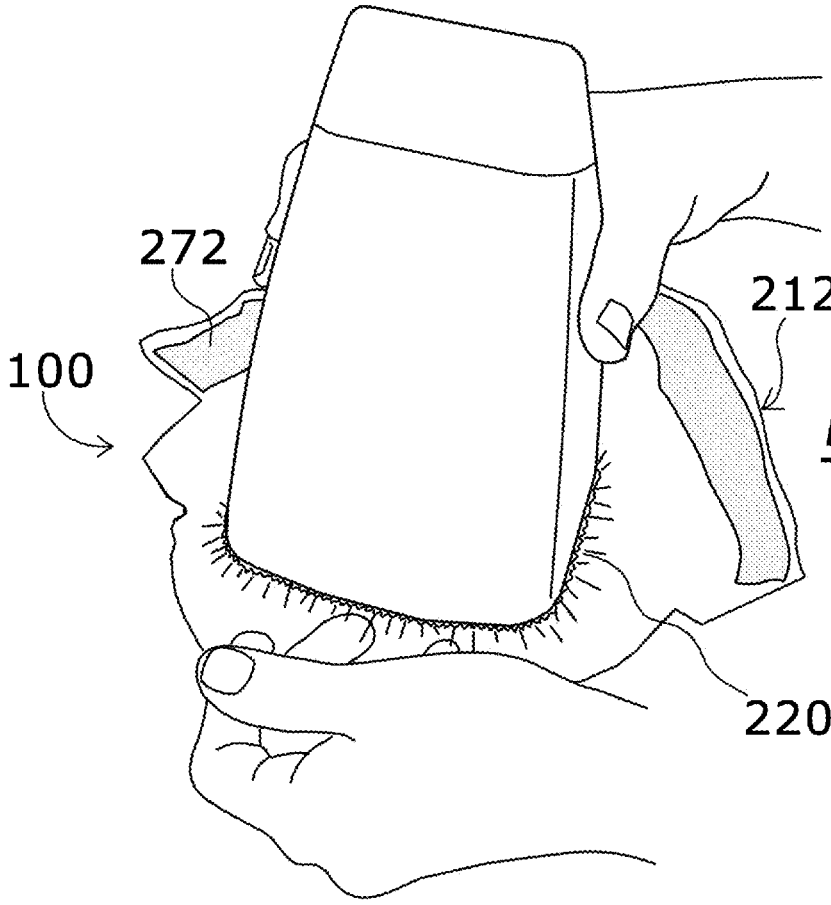
FIG. 29 shows bag being pulled over a detached waste canister from a bagless vacuum cleaner.

FIGS. 25-27 shows waste disposal bag 100 with handles 280 which can be any part of the bag projecting beyond the opening. FIG. 28 is a perspective view showing the constricted waist and the flaring of the bag opening. FIG. 29 shows the bag being pulled over a detached waste canister of a bagless vacuum in which the elasticized waist conforms to the shape of the canister. The bag is mounted over a portion of a vacuum cleaner by grasping the flared section on both sides of the bag in order to stretch the elasticized waist over the vacuum cleaner.

It should be understood that the drawings and detailed description herein are to be regarded in an illustrative rather than a restrictive manner, and are not intended to be rigidly limited to the particular forms and examples disclosed. For example, modifications to the bag structure such as the minimum and maximum diameter of opening 200 in order to accommodate a particular make and model of vacuum cleaner as well as the type of closure element(s) used to cinch and therefore temporarily reduce the opening for snug fitting about a vacuum cleaner body, as well as the type of elastic elements used for the waist and the particular method of applying the elastic elements to the bag can be altered as required without departing from the scope of the invention. The bag itself can be rectangular when seen in a plan orientation, or any other shape for fitment about a vacuum cleaner that will suggest itself to a person of ordinary skill in the art. Accordingly, it is intended that the invention encompass any further modifications, sealing configurations consistent with the disclosed bag structure, changes, rearrangements, substitutions, alternatives, design choices, and embodiments as would be appreciated by those of ordinary skill in the art having benefit of this disclosure, and which fall within the spirit and scope of the following claims.

The invention claimed is:

1. A waste transfer and disposal bag for bagless vacuum cleaners comprising:

(1) a bag including an opening with at least a first lip, an inner surface, an outer surface, a front side with a maximum width, a back side, a bottom edge, and, a projecting flap opposite from and superior to the first lip, the projecting flap extending beyond the opening, the projecting flap including a flap width, at least an inside surface, and wherein an uppermost portion of the projecting flap defines a top edge of the bag;

(2) a first adhesive strip with a peel away backing on the inside surface of the projecting flap, the first adhesive strip configured to span the flap width, the first adhesive strip located above the first lip of the bag, and the first adhesive strip adapted to temporarily form a first seal between the bag opening and a disconnected dust collection canister of a bagless vacuum cleaner, and, wherein the projecting flap is flexibly conformable and adhesively sealable around the dust collection canister; and, (3) an elastic member adapted to provide a circumferential seal about plural sizes of dust chutes of bagless vacuum cleaners, the elastic member forms an elastic annulus, the elastic annulus is stretchable over portions of the dust collection canister, and, the elastic annulus is configured to constrict to a relaxed state when the bag is not attached to the dust collection canister, and the elastic annulus in the relaxed state includes at least a maximum width transverse the front side of the bag less than one-half the maximum width of the front side of the bag in order to prevent escape of particulate matter.

2. The bag according to claim 1, further comprising a second adhesive strip inferior to the lip of the opening.

3. The bag according to claim 1, further comprising a pressure sensitive adhesive.

4. The bag according to claim 1, further comprising a bag closure formed when the projecting portion of the bag is adhered to another portion of the bag to occlude the bag opening.

5. The bag according to claim 1, further comprising further comprising gathers on the projecting flap.

6. A waste transfer and disposal bag for bagless vacuum cleaners comprising: (1) a bag including an opening including at least a first lip, the bag including an inner surface, an outer surface, a front side, a back side, a bottom edge including a maximum width, and, a projecting flap opposite from and superior to the first lip, the projecting flap configured to extend beyond the opening, the projecting flap including a second width, at least an inside surface, and wherein a top portion of the projecting flap defines an uppermost edge of the bag;

(2) a first adhesive strip with a peel away backing on the inside surface of the projecting flap, the first adhesive strip configured to span the second width, the first adhesive strip located above the first lip of the bag, and the first adhesive strip adapted to temporarily form a coupling between the bag opening and a dust chute of a disconnected dust collection canister of a bagless vacuum cleaner wherein the projecting flap is flexibly conformable and adhesively sealable around the dust collection canister; and, (3) an elastic annulus adapted to provide a continuous circumferential seal around plural sizes of dust chutes, the elastic annulus is stretchable over portions of the dust collection canister, the elastic annulus includes a relaxed state with a maximum width when not attached to a dust chute, and the maximum width of the elastic annulus in the relaxed state is less than one-half the maximum width of the bottom edge of the bag in order to prevent escape of particulate matter.

7. The bag according to claim 6, further comprising a second adhesive strip inferior to the lip of the opening.

8. The bag according to claim 6, further comprising a bag closure formed when the projecting portion of the bag is adhered to another portion of the bag to occlude the bag opening.

9. The bag according to claim 6, further comprising gathers on the projecting flap.

10. The bag according to claim 6, further comprising a pressure sensitive adhesive.

* * * * *